US009932971B2

(12) United States Patent
Hofer

(10) Patent No.: US 9,932,971 B2
(45) Date of Patent: Apr. 3, 2018

(54) SWASH PLATE COMPRESSOR HAVING A CURVED PISTON GUIDE WALL

(71) Applicant: Alfred Kärcher GmbH & Co. KG, Winnenden (DE)

(72) Inventor: Thomas Hofer, Auenwald (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 0 days.

(21) Appl. No.: 14/251,018

(22) Filed: Apr. 11, 2014

(65) Prior Publication Data

US 2014/0219832 A1 Aug. 7, 2014

Related U.S. Application Data

(63) Continuation of application No. PCT/EP2012/069867, filed on Oct. 8, 2012.

(30) Foreign Application Priority Data

Oct. 12, 2011 (DE) ..... 10 2011 054 442

(51) Int. Cl.
*F04B 1/14* (2006.01)
*F04B 27/10* (2006.01)
*F04B 39/12* (2006.01)

(52) U.S. Cl.
CPC ..... *F04B 1/145* (2013.01); *F04B 1/143* (2013.01); *F04B 27/1081* (2013.01); *F04B 39/122* (2013.01)

(58) Field of Classification Search
CPC .. F04B 1/143; F04B 1/145; F04B 1/14; F04B 1/122; F04B 1/141; F04B 27/10;
(Continued)

(56) References Cited

U.S. PATENT DOCUMENTS 2,374,595 A * 4/1945 Franz ..... F01B 3/0002 417/269
4,583,921 A * 4/1986 Wolff ..... F04B 1/124 417/269

(Continued)

FOREIGN PATENT DOCUMENTS

DE 39 28 006 3/1990
DE 39 18 022 12/1990

(Continued)

OTHER PUBLICATIONS

International Preliminary Report on Patentability of International Application No. PCT/EP2012/069867, filed Oct. 8, 2012, (translated to English); 6 Pages.*

(Continued)

*Primary Examiner* — Bryan Lettman
*Assistant Examiner* — Timothy Solak
(74) *Attorney, Agent, or Firm* — Womble Bond Dickinson (US) LLP

(57) ABSTRACT

A piston pump for a high-pressure cleaning appliance is provided, which includes a plurality of pistons that are movable back and forth and each of which enters a pump chamber and is displaceably held at a piston guiding part. The piston guiding part has a supporting wall on which a plurality of guiding elements, each of which guides a piston, are disposed. In order to be able to produce the piston pump in a more cost-effective manner, it is proposed according to the invention that the supporting wall is curved.

9 Claims, 5 Drawing Sheets

(58) Field of Classification Search
CPC ..... F04B 27/1036; F04B 27/1045; F04B 27/1081; F04B 39/12; F04B 39/128; F04B 39/121; F04B 39/122; F04B 39/127; F04B 53/16
See application file for complete search history.

(56) References Cited

U.S. PATENT DOCUMENTS

| | | | | | |
|---|---|---|---|---|---|
| 6,056,515 | A * | 5/2000 | Cuneo | F04B 1/148 417/271 |
| 6,092,998 | A * | 7/2000 | Dexter | F04B 1/143 417/269 |
| 2010/0290927 | A1* | 11/2010 | DaRif | F04B 1/145 417/271 |

FOREIGN PATENT DOCUMENTS

| | | | | |
|---|---|---|---|---|
| DE | 3918022 | * | 12/1990 | F04B 1/14 |
| DE | 89 16 257 | * | 5/1996 | F04B 1/14 |
| DE | 89 16 257 | U1 | 5/1996 | |
| DE | 295 21 522 | U1 | 6/1997 | |
| DE | 10 2005 050 009 | | 4/2007 | |
| DE | 10 2007 003 521 | | 7/2008 | |
| DE | 10 2007 020 299 | | 10/2008 | |
| EP | 1 486 674 | | 12/2004 | |
| FR | 744077 | * | 4/1933 | F01B 3/02 |
| GB | 672173 | | 5/1952 | |
| GB | 1085511 | | 10/1967 | |

OTHER PUBLICATIONS

International Search Report of PCT/EP2012/069867, dated Jan. 30, 2013; total 7 pages.*

* cited by examiner

SWASH PLATE COMPRESSOR HAVING A CURVED PISTON GUIDE WALL

CROSS-REFERENCE TO RELATED APPLICATIONS

The present application is a continuation of international application No. PCT/EP2012/069867, filed on Oct. 8, 2012, which claims the benefit of German application No. 10 2011 054 442.9, filed on Oct. 12, 2011, the entire specification of both being incorporated herein by reference.

BACKGROUND OF THE INVENTION

The invention relates to a piston pump for a high-pressure cleaning appliance, comprising a plurality of pistons that are movable back and forth and each of which enters a pump chamber and is displaceably held at a piston guiding part, the piston guiding part having a supporting wall on which a plurality of guiding elements, each of which guides a piston, are disposed.

Piston pumps of this kind are known, for example, from DE 39 18 022 C2. By means of such a piston pump, a liquid, preferably water, can be drawn in, pressurized and subsequently discharged. For this purpose, the pump chamber is connected via a suction valve to a suction line for sucking in liquid, and is connected via a pressure valve to a pressure line for discharging pressurized liquid. An accessory appliance can be connected to the pressure line, for example, a high-pressure hose that carries at its free end a discharge device such as a spray lance or a spray nozzle.

For delivering the liquid, the pistons are moved in a reciprocating manner such that the volumes of the pump chambers change periodically for suctioning, pressurizing and discharging the liquid. The pistons are displaceably held at a piston guiding part that has a supporting wall and a plurality of guiding elements. The guiding elements each guide a piston. In many cases, the supporting wall forms a cover that is attached to the housing of a drive mechanism, for example, the housing of a wobble plate against which the pistons rest and which is set in rotation by a motor.

The piston guiding part is subjected to high mechanical load. It therefore usually has reinforcement ribs and a significant material thickness. This results in increased production costs for the piston pump.

It is an object of the present invention to improve a piston pump of the aforementioned kind in such a manner that it can be produced in a more cost-effective manner.

SUMMARY OF THE INVENTION

This object is achieved according to the invention with a piston pump of the generic kind, in that the supporting wall is curved.

In the piston pump according to the invention, a piston guiding part having a curved supporting wall is used. Due to the curvature of the supporting wall, on the one hand the mechanical load capacity of the piston guiding part can be significantly increased without the supporting wall requiring reinforcement ribs or a great material thickness for this purpose. On the other hand, due to the curved shape of the supporting wall, its surface area is increased so that the supporting wall also has improved thermal load capacity since due to the greater surface area, reliable heat dissipation is ensured without necessarily having to provide cooling ribs for the supporting wall. The comparatively low material input required for the supporting wall reduces the weight of the piston guiding part. Moreover, the piston guiding part having the curved supporting wall can be produced in a cost-effective manner so that the production costs of the piston pump can be reduced.

It is particularly advantageous when the supporting wall is curved in the same direction on its front side facing the pump chambers and on its rear side facing away from the pump chambers. The supporting wall thus forms a cavity or a deepened region that provides the supporting wall with particularly high mechanical stability.

In a preferred embodiment, the supporting wall is curved in the manner of a spherical cap. For example, the supporting wall can form a spherically cap-shaped cover of a housing that accommodates a drive mechanism for the pistons.

In a preferred embodiment of the invention, the supporting wall is curved in the direction facing the pump chambers or in the direction facing away from the pump chambers. This has the advantage that the central region of the supporting wall is axially offset with respect to its outer circumference.

The guiding elements are preferably integrally connected to the supporting wall and protrude from the supporting wall on the side of the supporting wall facing away from the pump chambers. For example, it can be provided that the supporting wall is curved in the direction toward the pump chambers so that the supporting wall, on its side facing away from the pump chambers, forms a deepened region or a cavity into which the guiding elements extend.

For example, the supporting wall can form a cover for a wobble plate housing, the cover being curved outwardly or extending into the housing.

Particularly high mechanical stability is achieved in an advantageous embodiment in that the guiding elements have a base that is integrally connected to the supporting wall and protrudes at least from one side of the supporting wall. It is advantageous for the base to protrude from the supporting wall on both sides thereof.

For increasing the mechanical and thermal load capacity of the piston guiding part, radially protruding reinforcement ribs are preferably formed on the outer sides of the guiding elements.

It is advantageous when the guiding elements have a base which protrudes from the supporting wall on the side of the supporting wall facing the pump chambers, and which carries radially protruding reinforcement ribs on its outer side. Due to the use of reinforcement ribs, the amount of material used for the bases can be kept low without affecting their mechanical or thermal load capacity. It is particularly advantageous for the reinforcement ribs to protrude beyond the bases in the axial direction. With their axially protruding region, the reinforcement ribs define a receiving space for a ring-shaped component of the piston pump, which ring-shaped component surrounds in the circumferential direction the piston which passes through the guiding element. This can be, for example, a guiding ring or a sealing ring. In a configuration of this kind, the reinforcement ribs serve not only the purpose of increasing the mechanical stability of the bases, but, moreover, they also serve for fixing a ring-shaped component that surrounds a piston in the circumferential direction.

In an advantageous embodiment of the invention, the guiding elements have a base that is integrally connected to the supporting wall and which is adjoined by a guide sleeve in the axial direction, which guide sleeve encloses a piston in a positive-fitting manner in the circumferential direction. The base can have a greater material thickness than the guide sleeve. In particular, it can be provided that the outer side of the base transitions into the outer side of the guide sleeve via an inwardly directed, preferably radially oriented, step.

Radially protruding reinforcement ribs are advantageously formed on the outer side of the guide sleeves.

Particularly high mechanical stability is achieved in a preferred embodiment of the invention in that a cylindrical collar is formed on the outer circumference of the supporting wall. In a preferred configuration, the cylindrical collar engages into a cylindrical housing of a wobble plate.

The following description of preferred embodiments of the invention in connection with the drawing serves for a more detailed explanation.

DETAILED DESCRIPTION OF THE INVENTION

Figure 1:
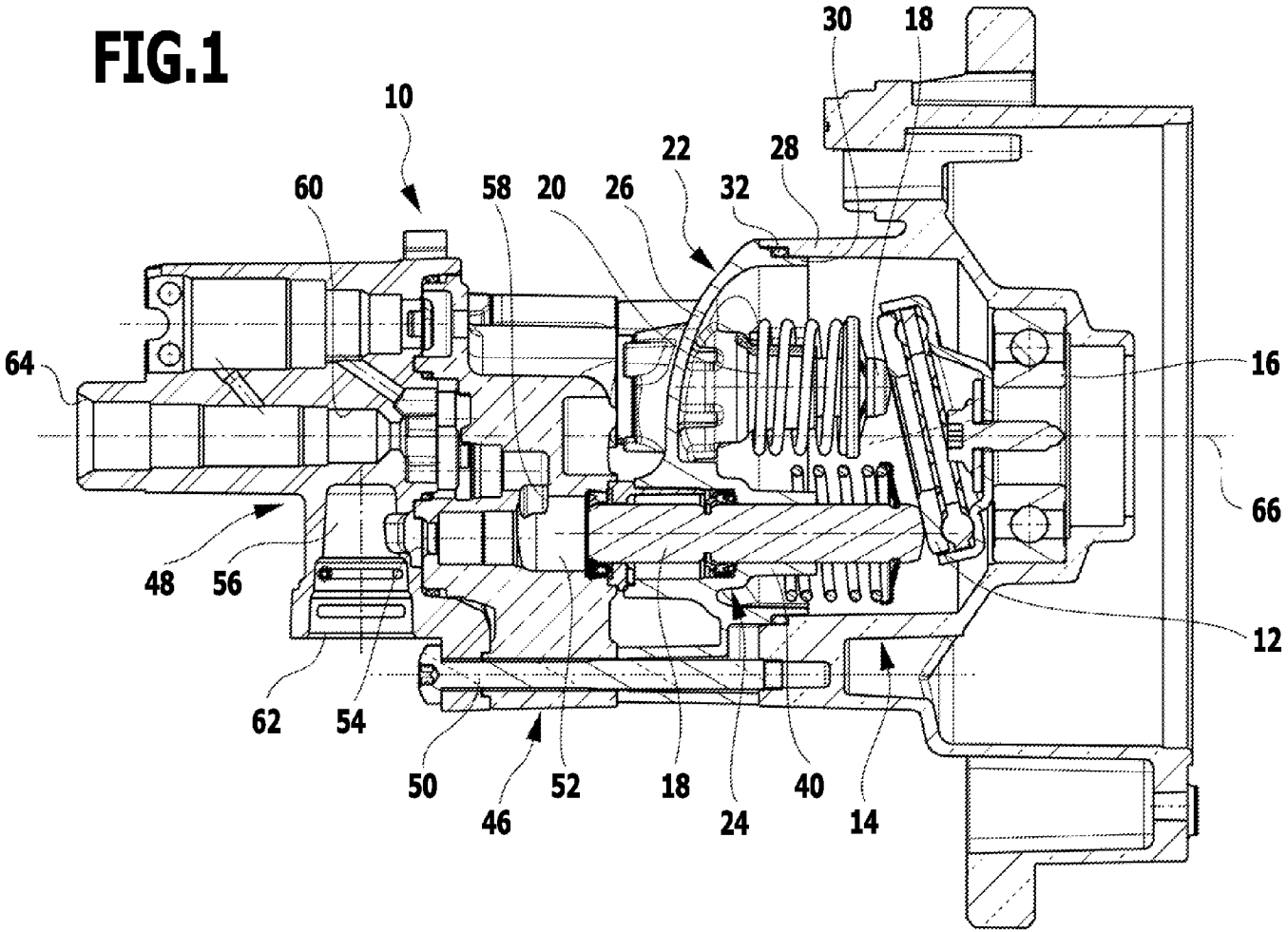
FIG. 1 shows a schematic sectional view of a first embodiment of a piston pump according to the invention.
Figure 2:
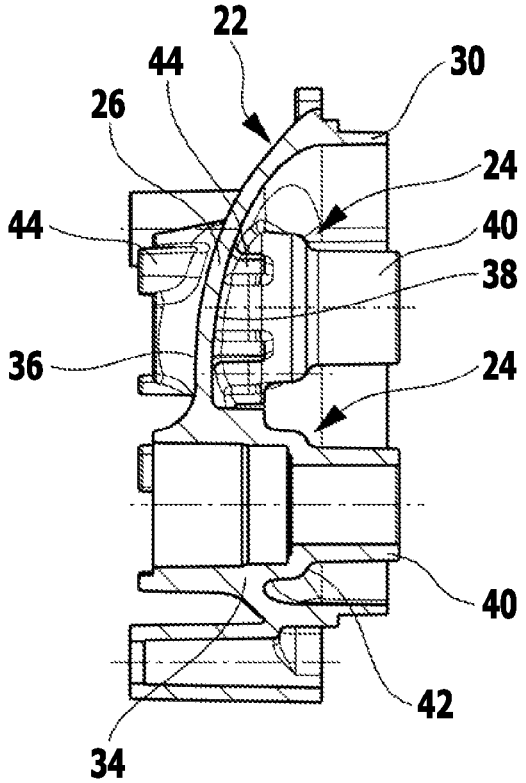
FIG. 2 shows a sectional view of a piston guiding part of the piston pump from FIG. 1.
Figure 3:
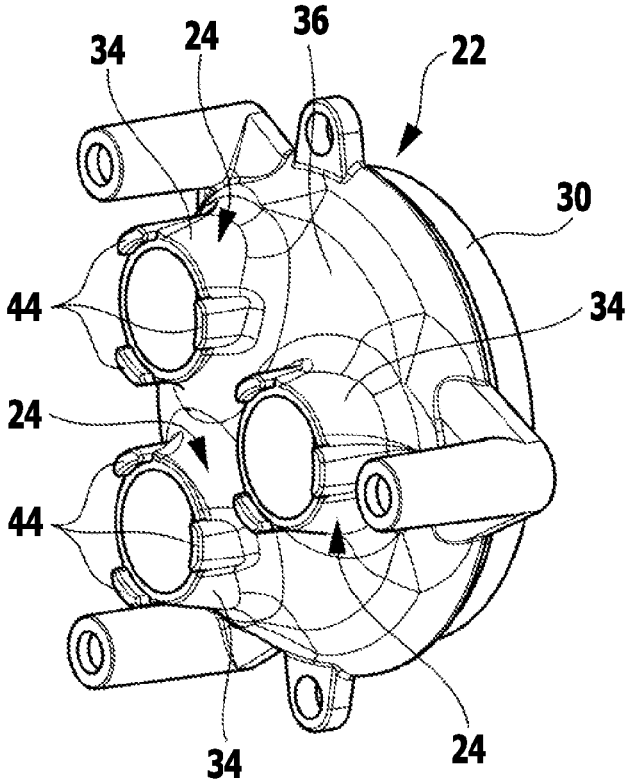
FIG. 3 shows a perspective illustration of the piston guiding part from FIG. 2, viewed diagonally from the front.

FIGS. 1 to 4 schematically illustrate a first embodiment of a piston pump according to the invention, which as a whole is designated by reference number 10. The piston pump can be attached in a customary manner to a motor, not shown in the drawing, which rotationally drives a wobble plate 12 that is rotatably mounted in a wobble plate housing 14 by means of a ball bearing 16. The piston pump 10 comprises a plurality of identically configured pistons 18 that rest against the front side of the wobble plate 12 facing away from the ball bearing 16, and are pressed toward the wobble plate 12 by means of return springs 20. The pistons 18 are held at a piston guiding part 22 of the piston pump 10 in a linearly displaceable manner. For this purpose, the piston guiding part 22 has guiding elements 24, each of which guides a piston 18 and is integrally connected to a supporting wall 26 of the piston guiding part 22.

The supporting wall 26 is configured in the manner of a spherical cap, and in the embodiment illustrated in FIGS. 1 to 4, it is curved in the direction facing away from the wobble plate 12. The supporting wall forms a cover that is mounted onto a cylindrical casing 28 of the wobble plate housing 14. A cylindrical collar 30 is foamed on the outer circumference of the supporting wall 26, and engages into the casing 28 of the wobble plate housing 14 with a sealing element 32 being situated in between.

The guiding elements 24 have an identical design, and in each case comprise a cylindrical base 34 that is integrally connected to the supporting wall 26 and protrudes from the supporting wall on the front side 36 of the supporting wall 26 facing away from the wobble plate 12, and also on the rear side 38 of the supporting wall 26 facing the wobble plate 12. In the direction toward the wobble plate 12, a guide sleeve 40 is integrally connected to the base 34 and encloses the respective piston 18 in a positive manner. The material thickness of the base 34 is selected to be greater than the material thickness of the guide sleeve 40.

Figure 4:
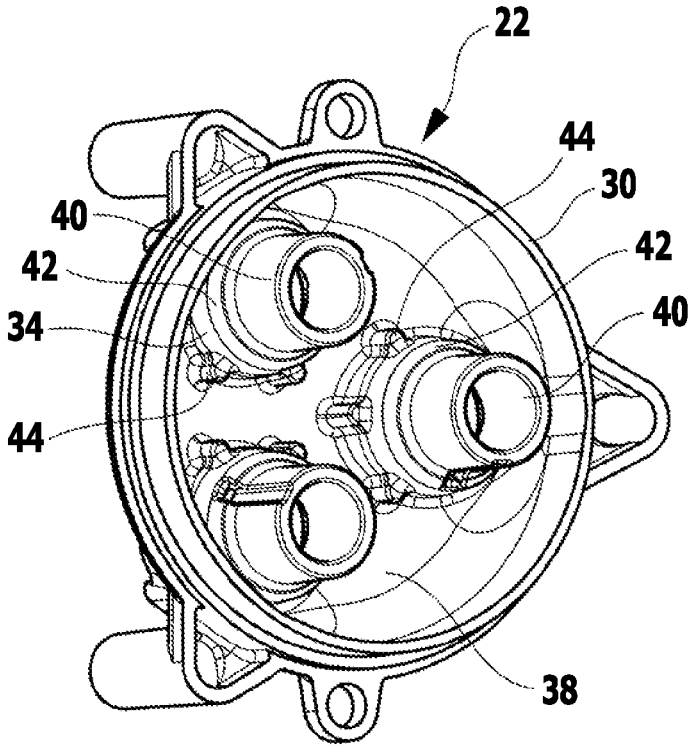
FIG. 4 shows a perspective illustration of the piston guiding part from FIG. 2, viewed diagonally from the rear.
Figure 6:
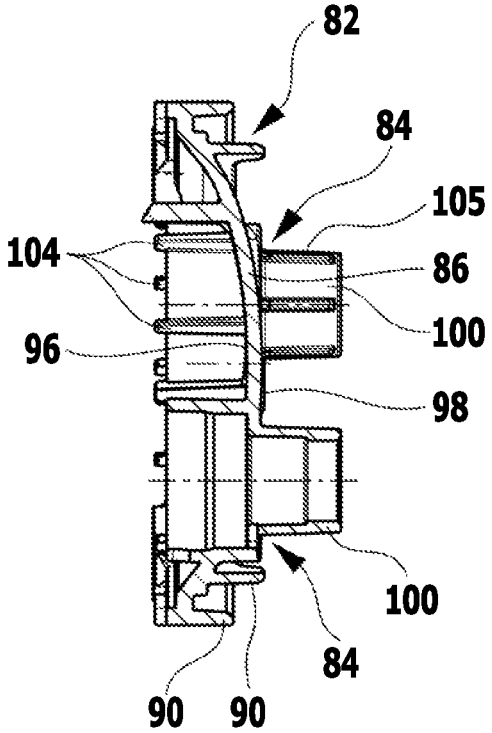
FIG. 6 shows a sectional view of a piston guiding part of the piston pump from FIG. 5.
Figure 5:
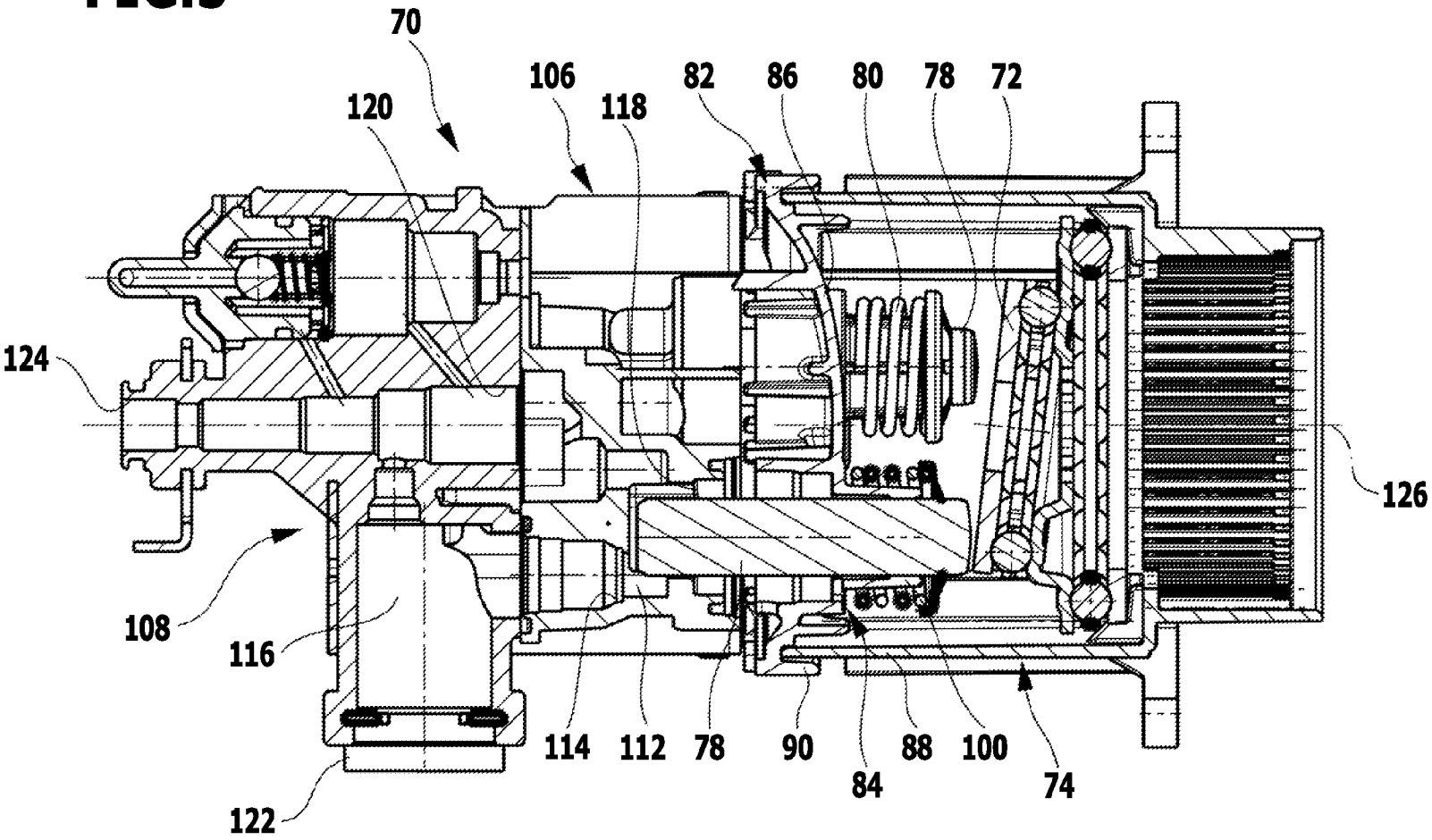
FIG. 5 shows a sectional view of a second embodiment of a piston pump according to the invention.
Figure 7:
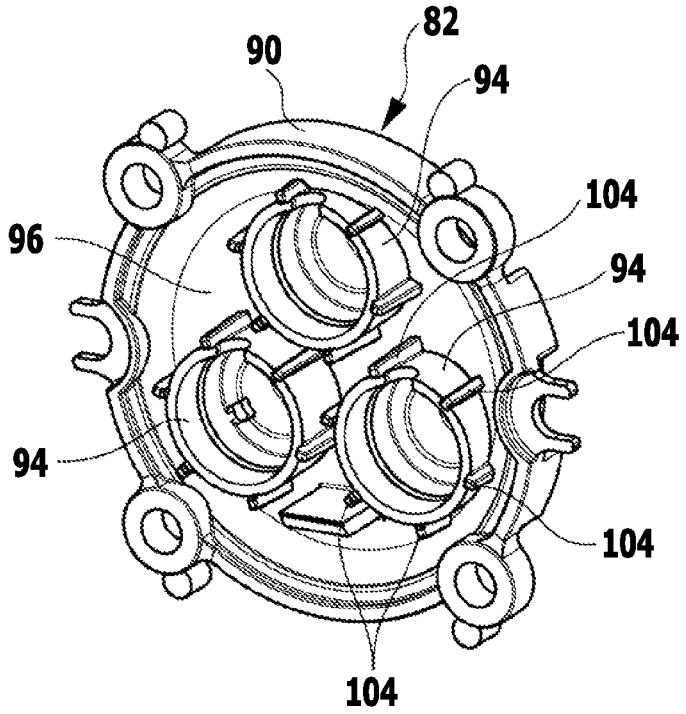
FIG. 7 shows a perspective illustration of the piston guiding part from FIG. 6, viewed diagonally from the front.
Figure 8:
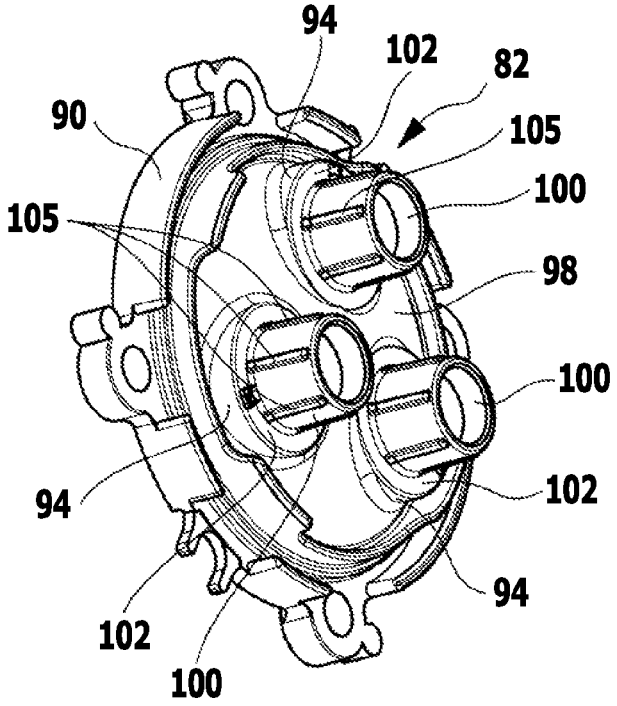
FIG. 8 shows a perspective illustration of the piston guiding part from FIG. 6, viewed diagonally from the rear.

As is apparent in particular from FIG. 4, the outer sides of the bases 34 transition into the outer sides of the guide sleeves 40 via radially inwardly oriented steps 42. Reinforcement ribs 44 are integrally formed onto the outer sides of the bases 34, and protrude radially on both sides of the supporting wall 26 and are disposed uniformly distributed over the peripheries of the bases 34. The reinforcement ribs 44 disposed on the front side 36 of the supporting wall 26 protrude beyond the cylindrical bases 34 in the axial direction. This is apparent in particular from FIG. 3.

In contrast to the bases 34, the guide sleeves 40 formed on the bases 34 on the rear side 38 of the supporting wall 26 have no reinforcement ribs on the outside.

A pump block 46 of the piston pump 10 is attached to the piston guiding part 22, and a pump head 48 of the piston pump 10 is attached to the pump block 46. The pump block 46 and the piston guiding part 22 are clamped between the pump head 48 and the wobble plate housing 14 by means of tensioning screws 50.

The pump block 46 has pump chambers 52 each of which a piston 18 enters and which are in flow communication with a suction line 56 via an inlet opening 54, and are in flow communication with a pressure line 60 via an outlet opening 58. A suction valve known per se, which is not illustrated in the drawing, is disposed in each case between the pump chambers 52 and the suction line 56, and a pressure valve known per se, which is not illustrated in the drawing, is disposed in each case between the pump chambers 52 and the pressure line 60.

The suction line 56 connects the pump chambers 52 to a suction inlet 62 of the piston pump 10, to which a suction hose, for example, can be connected. The pressure line 60 connects the pump chambers 52 to a pressure outlet 64 of the piston pump 10, to which a pressure hose, for example, can be connected.

When the wobble plate 12 is set in rotation about its axis of rotation 66, the pistons 18 perform a reciprocating movement parallel to the axis of rotation 66, the pistons thereby periodically changing the volume of the respective pump chamber 52 which they enter so that liquid can be drawn into the pump chamber 52 via the suction inlet 62 and the suction line 56, subsequently pressurized and then discharged via the pressure line 60 and the pressure outlet 64. The pistons 18 are guided in the axial direction, i.e., parallel to the axis of rotation 66, by means of the piston guiding part 22. For this purpose, the pistons 18 in each case slide along a guide sleeve 40 that is integrally connected to the supporting wall 26 via a base 34. Due to its spherical cap-shaped configuration, the supporting wall has high mechanical stability that is increased by the cylindrical collar 30 which is aligned concentrically with respect to the axis of rotation 66 and is integrally connected to the supporting wall 26. Moreover, the supporting wall 26 is characterized by high thermal stability since it has a comparatively large surface via which heat can be dissipated.

FIGS. 5 to 8 illustrate a second advantageous embodiment of a piston pump according to the invention, designated as a whole by reference number 70. The piston pump 70 is configured similarly to the piston pump 10 described above. The piston pump 70 is driven by a wobble plate 72 that is rotatably mounted in a wobble plate housing 74 and is set in rotation by a motor, not illustrated in the drawing.

Pistons 78, which are pushed by return springs 80 toward the wobble plate 72, rest against the wobble plate 72. The pistons 78 are held at a piston guiding part 82 so as to be displaceable in the axial direction. The piston guiding part 82 comprises guiding elements 84 that are integrally connected to a supporting wall 86 of the piston guiding part 82. The supporting wall 86 is attached to a casing 88 of the wobble plate housing 74, and a cylindrical collar 90 is formed on the outer circumference of the supporting wall 86 and encloses an end portion of the casing 88 in the circumferential direction.

Similar to the supporting wall 26 of the piston pump 10 described above with reference to FIGS. 1 to 4, the supporting wall 86 of the piston pump 70 is also configured in the manner of a spherical cap. However, in contrast to the supporting wall 26, the supporting wall 86 is curved in the direction facing the wobble plate 72. Thus, on its front side 96 facing away from the wobble plate 72, the supporting wall 86 forms a deepened region or cavity, and with its rear side 98 facing the wobble plate 72, the supporting wall projects into the wobble plate housing 74.

The guiding elements 84 of the piston pump 70 each comprise a cylindrical base 94 that is integrally formed onto the supporting wall 86 and protrudes beyond the supporting wall 86 on the front side 96 and also on the rear side 98. A guide sleeve 100 that faces the wobble plate 72 is integrally connected to the base 94, the material thickness of the guide sleeve being selected to be less than the material thickness of the cylindrical base 94. The outer side of the cylindrical base 94 transitions into the outer side of the guide sleeve 100 via a radially inwardly oriented step 102. This is apparent in particular from FIG. 8.

The cylindrical base 94 has reinforcement ribs 104 only on the outer side of its region protruding beyond the front side 96, whereas the outer side of the region of the cylindrical base 94 protruding beyond the rear side 98 carries no reinforcement ribs. Instead, further reinforcement ribs 105 are formed on the outer side of the guide sleeves 100, and allow the material thickness of the guide sleeves 100 to be kept low without affecting the mechanical or thermal stability of the guide sleeves 100.

The piston pump 70 comprises a pump block 106 that is attached to the piston guiding part 82, and a pump head 108 that is attached to the pump block 106. The pump block 106 and the piston guiding part 82 are clamped between the pump head 108 and the wobble plate housing 74 by means of tensioning screws, not illustrated in the drawing.

The pump block 106 has pump chambers 112 each of which a piston 78 enters, and which are in flow communication with a suction line 116 via an inlet opening 114, and are in flow communication with a pressure line 120 via an outlet opening 118. The pump chambers 112 are connected to a suction inlet 122 via the suction line 116, and the pump chambers 112 are connected to a pressure outlet 124 via the pressure line 120. A suction valve, known per se to the person skilled in the art and not illustrated in the drawing, is disposed in each case between the pump chambers 112 and the suction line 116, and a pressure valve, known per se to the person skilled in the art and not illustrated in the drawing, is disposed in each case between the pump chambers 112 and the pressure line 120.

When the wobble plate 72 is set in rotation about its axis of rotation 126, the pistons 78 are moved in a reciprocating manner so that the volume of the respective pump chamber 112 into which the pistons 78 plunge changes periodically for sucking in, pressurizing and discharging liquid. Each of the pistons is guided in the axial direction, i.e., parallel to the axis of rotation 126, by a guide sleeve 100 which is integrally connected to the supporting wall 86 via a cylindrical base 94. Due to its curved configuration, the supporting wall 86 has high mechanical and thermal stability. The mechanical stability is additionally increased by the collar 90 that is formed on the supporting wall 86 and is aligned concentrically with respect to the axis of rotation 126.

The invention claimed is:

1. A piston pump for a high-pressure cleaning appliance, comprising a plurality of pistons that are movable back and forth and each of which enters a pump chamber and is displaceably held at a piston guiding part, the piston guiding part having a supporting wall on which a plurality of guiding elements, each of which guides a piston, are disposed, the supporting wall being curved;

wherein the supporting wall is configured in the manner of a spherical cap;

wherein the supporting wall forms a spherically cap-shaped cover of a housing that accommodates a drive mechanism for the pistons;

wherein the guiding elements have a cylindrical base that is integrally connected to the supporting wall and protrudes from the supporting wall on both sides thereof; wherein the base is integrally connected to a guide sleeve; wherein a material thickness of the base is greater than a material thickness of the guide sleeve; and wherein outer sides of the base transition into outer sides of the guide sleeve via radially inwardly oriented steps.

2. The piston pump according to claim 1, wherein the supporting wall is bended towards inside of the housing or towards outside the housing both on its front side facing the pump chambers and on its rear side facing away from the pump chambers.

3. The piston pump according to claim 1, wherein the supporting wall is bended in the direction facing the pump chambers or in the direction facing away from the pump chambers.

4. The piston pump according to claim 1, wherein the guiding elements are integrally connected to the supporting wall and protrude from the supporting wall on the rear side of the supporting wall facing away from the pump chambers.

5. The piston pump according to claim 1, wherein radially protruding reinforcement ribs are formed on the outer sides of the guiding elements.

6. The piston pump according to claim 1, wherein the base of the guiding elements protrudes from the supporting wall on the side of the supporting wall facing the pump chambers, and which carries radially protruding reinforcement ribs on its outer side which protrude beyond the base in an axial direction of the pump.

7. The piston pump according to claim 1, wherein a cylindrical collar is formed on the outer circumference of the supporting wall.

8. The piston pump according to claim 1, wherein the base of the guiding elements is integrally connected to the supporting wall and to which the guide sleeve is connected in an axial direction of the pump, which guide sleeve encloses a piston in a positive-fitting manner in the circumferential direction.

9. The piston pump according to claim 8, wherein radially protruding reinforcement ribs are formed on the outer side of the guide sleeve.

* * * * *